US005163568A

United States Patent [19]

Laurendeau et al.

[11] Patent Number: 5,163,568

[45] Date of Patent: Nov. 17, 1992

[54] MOUNTING BRACKET FOR SHELVING ACCESSORY

[75] Inventors: Marc Laurendeau; Denis Martineau, both of St Jean Port Joli, Canada

[73] Assignee: Rousseau Metal Inc., St Jean Port Joli, Canada

[21] Appl. No.: 814,442

[22] Filed: Dec. 30, 1991

[51] Int. Cl.[5] ..... A47B 47/00

[52] U.S. Cl. ..... 211/187; 211/189; 211/208

[58] Field of Search ..... 211/187, 183, 190, 208; 108/111, 144

[56] References Cited

U.S. PATENT DOCUMENTS

| | | | |
|---|---|---|---|
| 2,505,299 | 4/1950 | Muller | 211/187 |
| 2,631,913 | 3/1953 | Rosenberg | 211/187 X |
| 2,932,409 | 4/1960 | Wineman, Jr. | 211/187 X |
| 3,297,374 | 1/1967 | Radek | 211/187 X |
| 3,305,286 | 2/1967 | Fenwick | 211/187 |

*Primary Examiner*—Alvin C. Chin-Shue
*Assistant Examiner*—Sarah A. Lechok
*Attorney, Agent, or Firm*—ROBIC

[57] ABSTRACT

A mounting bracket for use to install a shelving accessory such as a drawer, a roll frame or a flipper door, into an office shelving unit comprising two opposite pairs of posts forming together a supporting frame structure. The bracket comprises an elongated plate provided at both ends with two U-shaped end portions. One of these end portions is provided with holes, whereas the other end portion is provided with slots which extend over part of the outer wall and part of the bottom wall of the U-shape. These U-shaped portions and the presence of slots in one of them make it possible to install the mounting bracket in a retrofit manner between one of the sets of posts in which bolts are previously inserted at a required height.

8 Claims, 4 Drawing Sheets

FIG. 2
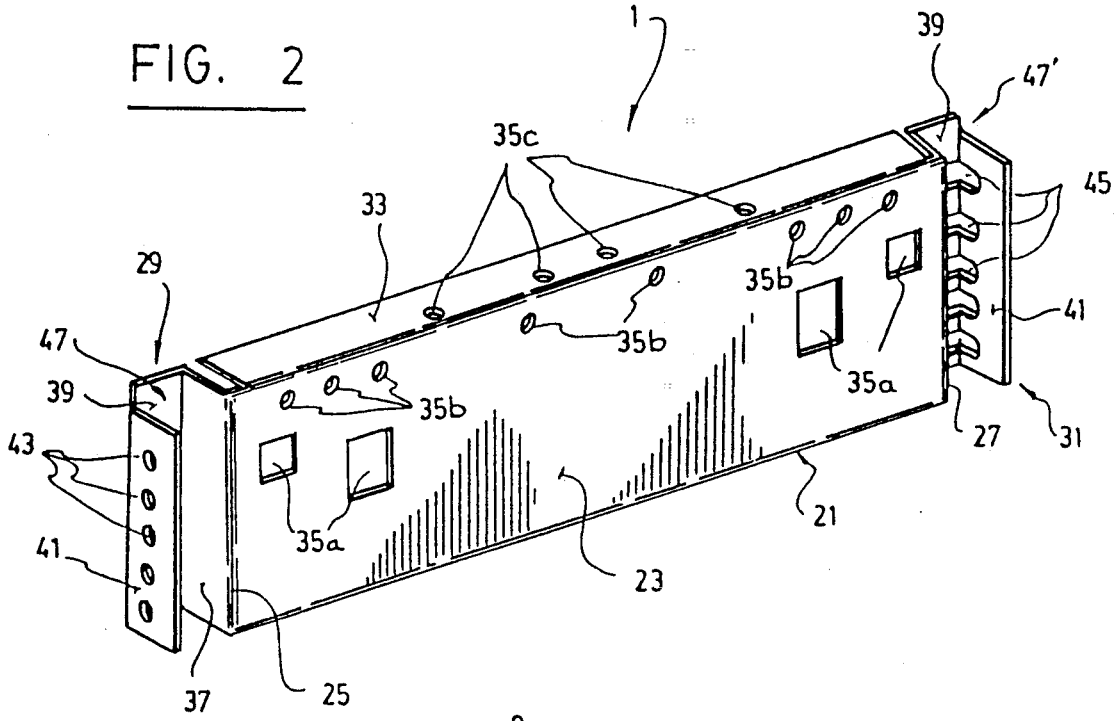
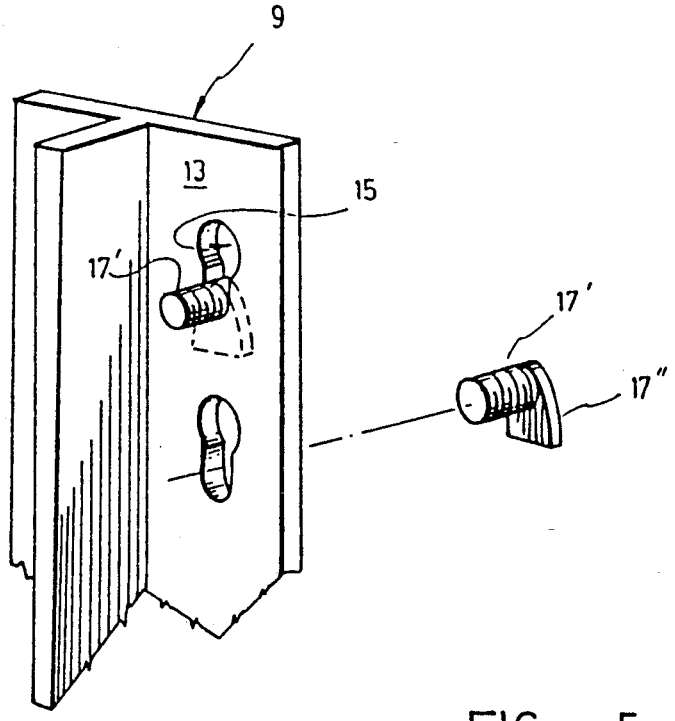
FIG. 5

MOUNTING BRACKET FOR SHELVING ACCESSORY

BACKGROUND OF THE INVENTION a) Field of the Invention

The present invention is concerned with a mounting bracket for use to install in a retrofit manner a shelving accessory into an office shelving of the type comprising at least two sets of front and rear posts forming together a supporting frame structure of rectangular cross-section.

By "shelving accessory", there is meant hereinafter any kind of open and closed file drawers, storage drawers, roll-out frames, flipper doors and suspended bars that may be attached either directly or, more often, through a pair of rails or runners, to the frame of an office shelving.

b) Brief description of the prior art

A great number of office shelvings of good quality presently available on the U.S. market, like those sold by AURORA, TENNSCO or SPACESAVER, include a rectangular frame structure of the above mentioned type, comprising two sets of L- or T-shaped front and rear posts. The front and rear posts of each set usually have perforated surfaces facing each other, each perforated surface comprising at least one vertical row of equally spaced apart openings in which bolts can be inserted.

The posts are designed to support the shelving accessories of the office shelving, which are attached either directly or through guiding rails or runners to a pair of lateral mounting brackets which are themselves rigidly attached with bolts to the opposite sets of posts. Usually, the attachment of the mounting brackets to the posts is made in the factory while the shelving is being assembled. Once attached, the mounting brackets are usually very hard to remove and change.

More and more often, it happens that owners of office shelvings want to "convert" them from one originally intended use to another one, which may require different kinds of drawers, roll-out frames or flipper doors. Such accessories are available as such on the market. However, it is almost impossible now to buy them and have them easily installed on an existing office shelving frame of the above mentioned type, for the reason explained hereinabove.

OBJECTS OF THE INVENTION

The object of the present invention is to provide a mounting bracket for use to install in a retrofit manner a shelving accessory into an office shelving of the above mentioned type, without having to dismantle the same.

In accordance with the invention, this object is achieved with a mounting bracket comprising:

(a) an elongated plate having a central portion defining a rectangular front surface with two opposite edges, and two opposite end portions adjacent the opposite edges, and (b) connecting means on the front surface to fix directly or indirectly one side of the shelving accessory.

The plate, including its two opposite end portions, has such a length as to fit snugly between the perforated facing surfaces of the front and rear posts of any one of the sets.

Each of the opposite end portions are U-shaped and includes:

an inner lateral wall integrally projecting rearwardly from the corresponding edge of the front surface;

a bottom wall extending parallel to the front surface rearwards the same; and an outer lateral wall projecting forwardly from the bottom wall, the outer lateral wall extending perpendicularly to the bottom wall and the front surface so as to extend flat onto one of the perforated facing surfaces of the front and rear posts of one of the sets when the mounting bracket is installed therebetween.

One of the opposite end portions of the bracket comprises a set of at least two holes extending through at least its outer lateral wall, these holes being respectively spaced apart so as to match at least two corresponding openings in the perforated surface of the adjacent post when installed.

The other one of the opposite end portions of the bracket comprises a set of at least two elongated , slots extending parallel to each other in a direction perpendicular or at angle with respect to the adjacent edge of the front surface, each slot extending over part of the outer lateral wall and part of the bottom wall of the other opposite end portion, these slots being respectively spaced apart so as to match at least two corresponding openings in the perforated surface of the adjacent post when installed.

In use, the mounting bracket can be installed into any of the sets of posts as follows.

(i) First, bolts are inserted into two pairs of facing openings selected at a required height in the perforated facing surfaces of the front and rear posts of the selected set, the openings in each post being selected , so as to match the slots or holes in the end portions of the mounting bracket.

(ii) Then, the mounting bracket is positioned so that its front surface faces the other set of front and rear posts and the one end portion of the mounting bracket comprising the holes is inserted onto the bolts set in place in one of the posts of the set.

(iii) The other end portion of the mounting bracket comprising the slots is then slid on the bolts set in the other one of the posts of the set, such a sliding being allowed by the slots which extend in the bottom wall of the other end portion and thus allow the bolts to pass through, and enter this other U-shaped end portion.

(iv) Nuts are then screwed onto the bolts projecting in said two U-shaped end portions to fix the same.

(v) Last of all, the shelving accessory may be fixed to the front surface of the mounting bracket or on top thereof and to the front surface of another identical mounting bracket similarly installed into the other set of front and rear posts, or on top of said other mounting bracket.

The mounting bracket according to the invention is particularly interesting inasmuch as it fits into numerous well known brands of office shelving units thereby making it possible to easily convert them whenever required.

The invention and its advantages will be better understood upon reading the following non-restrictive description of a preferred embodiment thereof, given with reference to the accompanying drawings.

BRIEF DESCRIPTION OF THE DRAWINGS

FIG. 2 is a front perspective view of a mounting bracket according to the invention.

FIG. 5 is a perspective view of a post and bolt assembly for use to install the mounting bracket of FIG. 2 into the shelving unit of FIG. 1.

DESCRIPTION OF A PREFERRED EMBODIMENT

Figure 4:
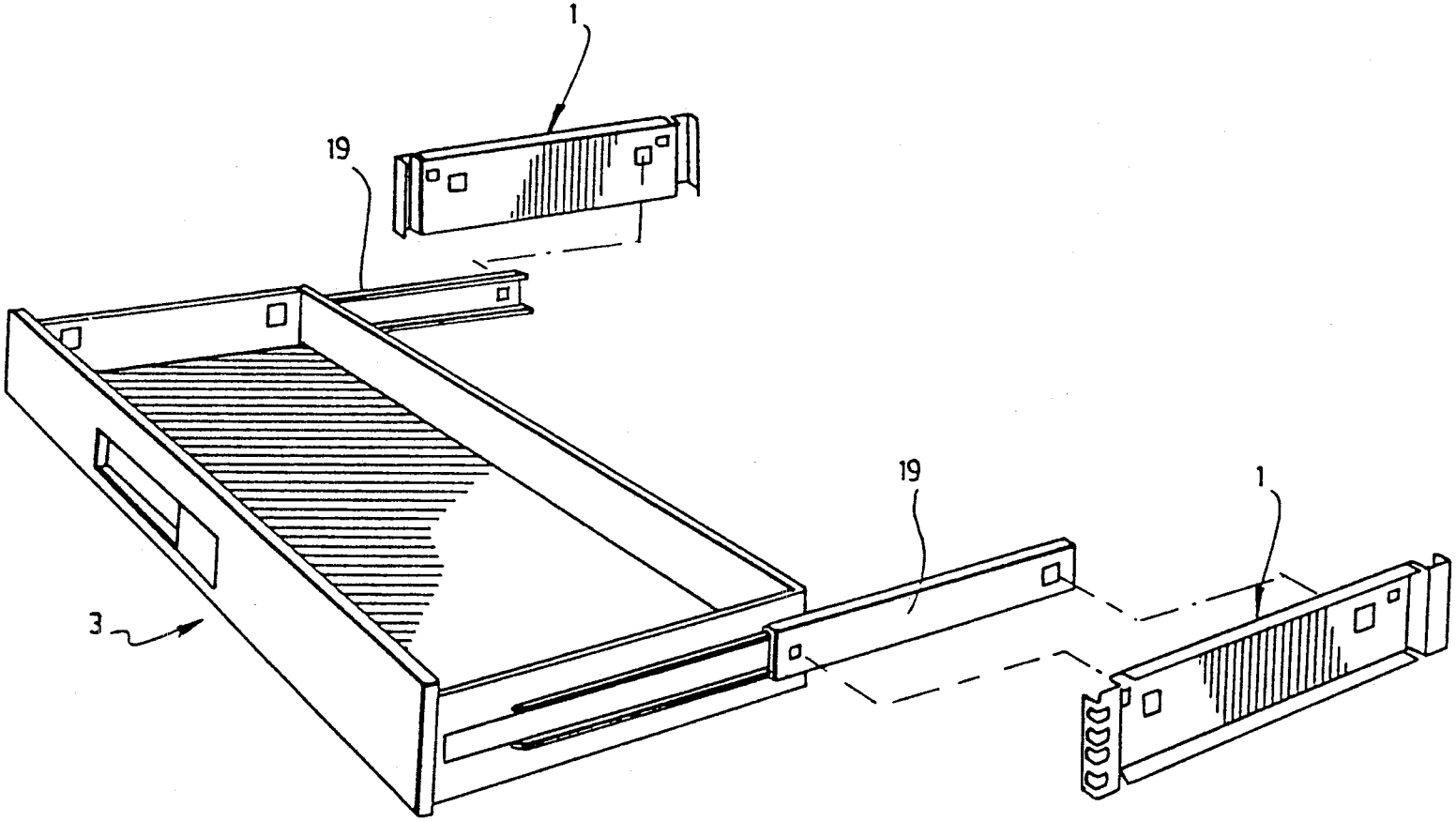
FIG. 4 is an exploded view showing how a drawer can be installed onto the mounting bracket of FIG. 2.

A mounting bracket 1 according to the invention is shown in FIG. 2. It is intended to be used to install in a retrofit manner a shelving accessory such as a flipper door 3' or a drawer 3 as shown in FIGS. 1 and 4, respectively into an office shelving unit 5 of conventional structure.

Figure 1:
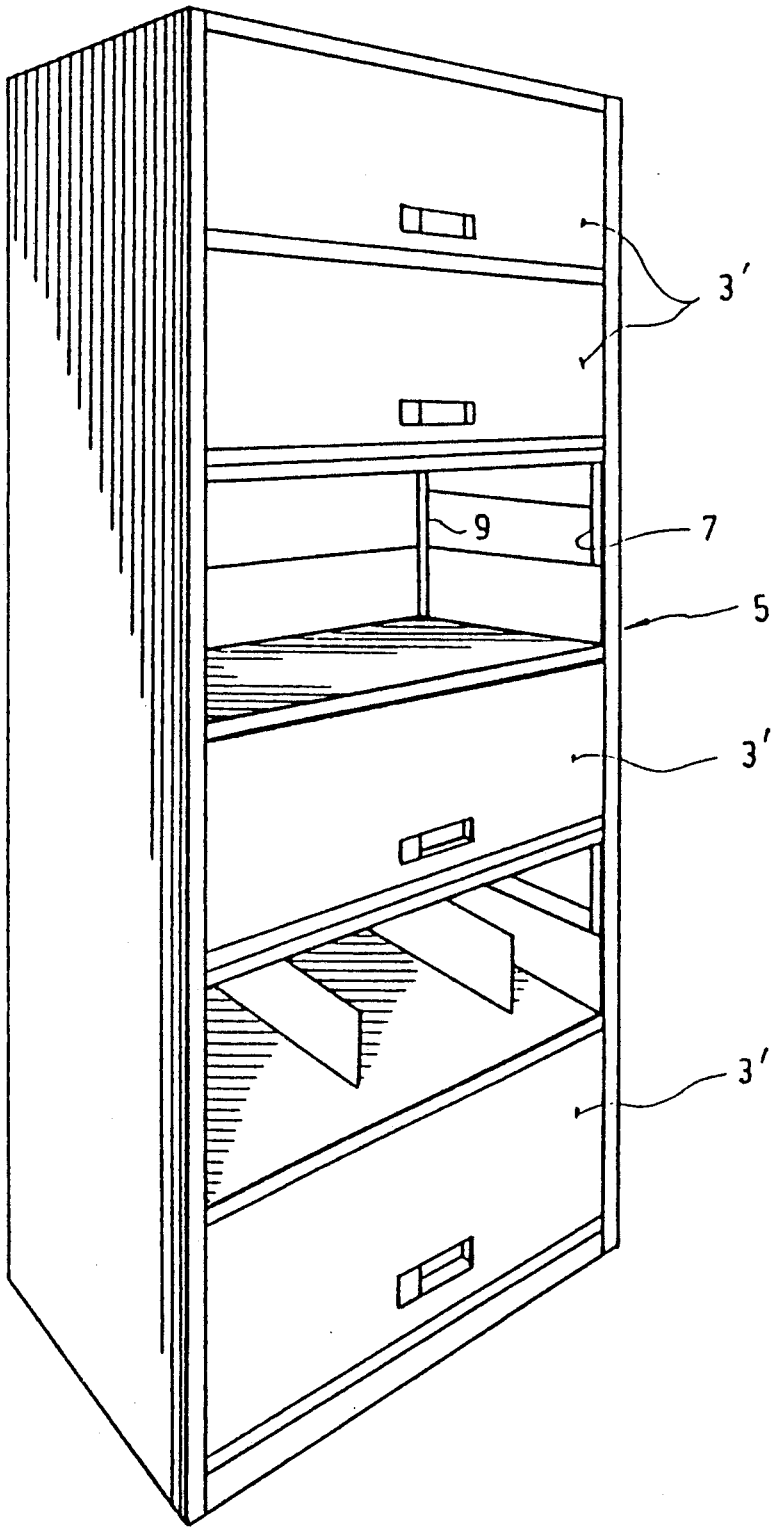
FIG. 1 a front perspective view of an office shelving unit provided with a plurality of drawers and flipper doors.
Figure 3:
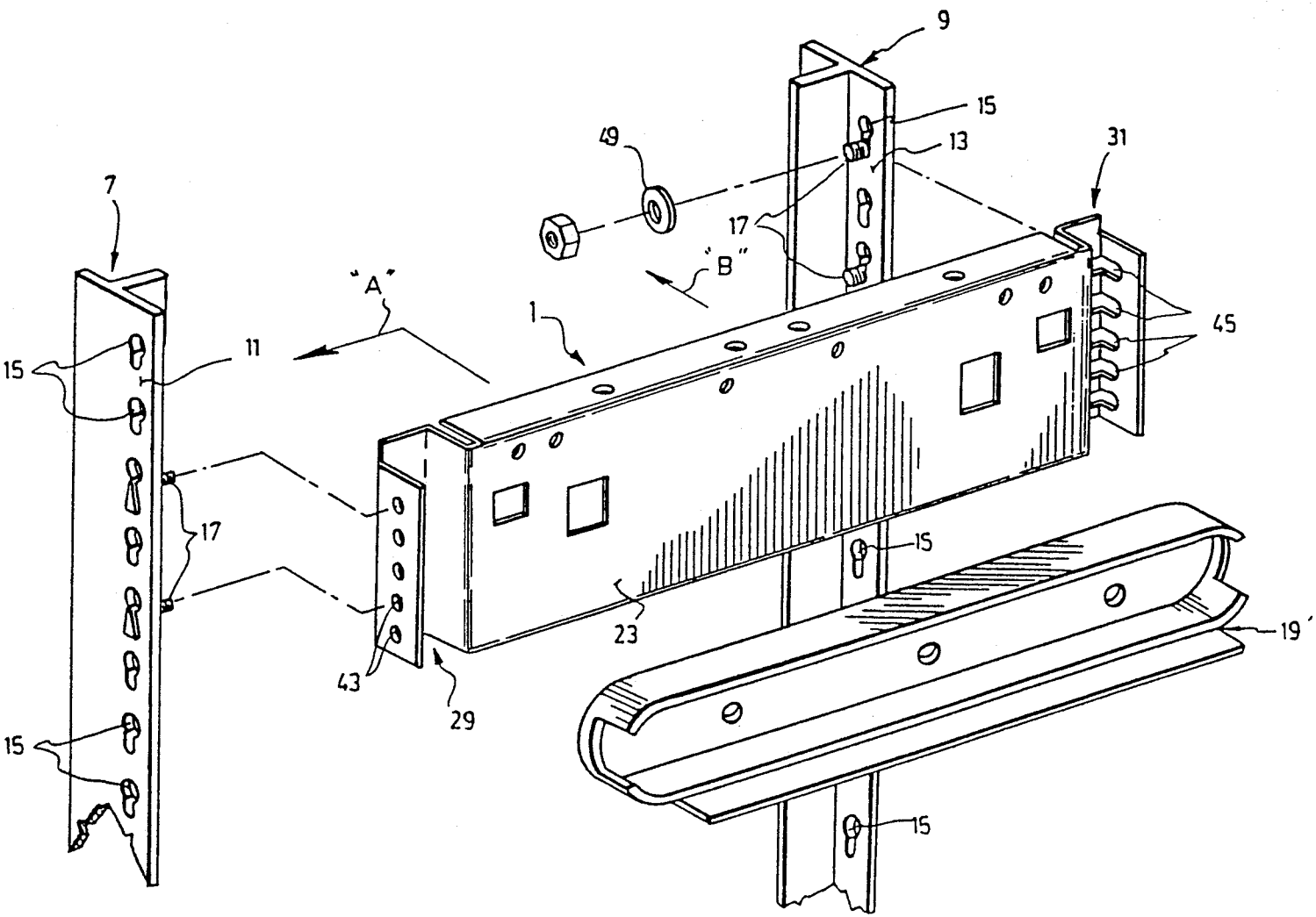
FIG. 3 is an exploded view showing how the mounting bracket of FIG. 2 can be installed on the frame of the shelving unit of FIG. 1.

As better shown in FIGS. 1 and 3, the shelving unit 5 into which the mounting bracket 1 is intended to be installed, comprises at least two sets of front and rear posts 7, 9 forming together a supporting frame structure of rectangular cross-section. The front and rear posts 7, 9 of each set are L- or T-shaped and have perforated surfaces 11, 13 that face each other. Each perforated surface 11, 13 comprises at least one vertical row of equally spaced apart openings 15 in which supporting bolts 17 can be inserted without having to dismantle the shelving unit 5.

Referring now to FIG. 2, the mounting bracket 1 consists of a single piece of metal, preferably steel, formed and punched into the desired shape. More particularly, the bracket 1 consists of an elongated plate having a central portion 21 defining a rectangular front surface 23 with two opposite edges 25, 27, and two opposite end portions 29, 31 adjacent the opposite edges.

Connecting means are provided on the front surface 23 and if desired, onto upper and lower flaps 33 edging the front surface 23, in order to fix directly or indirectly one side of the shelving accessory to be installed into the shelving unit. These connecting means preferably consist of through-holes 35 punched out in the front surface 23 or flaps 33, these through-holes 35 being sized and positioned to receive fixation hooks projecting from the shelving accessory to be attached or from the adjacent rail 19 or runner 19' supporting the same. In the illustrated embodiment, the large square holes **35*a* are preferably used to fix the rail 19 of a drawer 3. The set of holes 35*b* in the front surface is preferably used to fix the runner 19' of a flipper door, as shown in FIG. 3. Finally, the set of holes 35*e* in the upper flap 33** can be used to suspend transversal bars or similar items.

The plate, including its two opposite end portions 25, 27, have such a length as to fit snugly between the perforated facing surfaces 11, 13 of the front and rear posts 7, 9 of any one of the sets as shown in FIG. 3.

Each of the opposite end portions, is U-shaped and includes an inner lateral wall 37 integrally projecting rearwardly either perpendicularly as shown or at angle, from the corresponding edge 25 of the front surface 23. It also includes a bottom wall 39 extending parallel to the front surface 23 rearwards the same, and an outer lateral wall 41 projecting forwardly from the bottom wall 39. This outer lateral wall 41 extends perpendicularly to the bottom wall 39 and to the front surface 23 so as to extend flat onto the adjacent perforated surface 11 or 13 of the front or rear post 7 or 9 when the mounting bracket is installed therebetween.

One of the opposite end portions, say 29, comprises a set of at least two and preferably six or eight closely spaced apart holes 43 extending through its outer lateral wall 41. The holes 43 are spaced apart so that at least two of them match at least two corresponding openings 15 made in the perforated surface 11 of the adjacent post 7 when installed (see FIG. 3). As a variant (not shown), the end portion 29 could have a set of slots instead of set of holes 43, the slots extending parallel to each other over part of the outer lateral wall 41 and part of the bottom wall 39 of the end portion and being spaced apart in the same manner as above.

The other end portion 31 comprises a set of at least two and preferably six or eight closely spaced apart elongated slots 45 extending parallel to each other. The slots 45 are preferably perpendicular to the adjacent edge 27 of the front surface 23 as is shown, but they could be at angle if desired with respect to the edge 27. In accordance with a very important feature of the invention, each slot 45 extends over part of the outer lateral wall 41 and part of the bottom wall of the other opposite end portion 31. Once again, the slots are respectively spaced apart so that at least two of them match at least two corresponding openings 15 made in the perforated surface 13 of the adjacent post 9 when installed (see FIG. 3).

Advantageously, the spacing between the spaced apart holes 43 and slots 45 which are preferably horizontally aligned, is selected to be equal to a multiple of the spacing between the openings 15 of the front and rear posts 7, 9, in order to allow fine adjustment in height of the mounting bracket 1 along these front and rear posts.

In addition to the holes 43 and slots 45, the outer lateral walls 41 of the end portions 29, 31 may each be provided with a cut-out portion 47 at one end, to further facilitate the adjustment.

As can be noticed, the mounting bracket 1 disclosed hereinabove is reversible. Accordingly, it can be installed in the very same way either to the left or to the right of the shelving unit. Accordingly, only one of these installations will now be described.

In use, the mounting bracket 1 can be installed between the posts 7, 9 of any set by first inserting bolts 17 into two pairs of openings 15 selected at a required height in the perforated facing surfaces 11, 13 of the front and rear posts 7, 9 of the selected set. Two bolts 17 go at the front and two at the back. Of course, the openings 15 in each post must be selected so as to match some of the holes 43 and slots 45 made in the end portions 29, 31 of the mounting bracket 1.

Use can be made of standard bolts 17 whose heads are insertable into an enlarged portion provided for this purpose on top of each opening 15 (see FIG. 5). Alternatively, special bolt 17' can be used, as shown in FIG. 5, whose heads 17'' are flattened and shaped as hooks.

Then, the mounting bracket 1 has to be positioned as shown in FIG. 3, so that its front surface 23 faces the other set of front and rear posts. In such a position, the end portion 29 of the mounting bracket comprising the holes 43 is inserted onto the bolts 17 set in place in the adjacent post of the set, say post 7, as is shown with the arrow "A" in FIG. 3.

The other end portion 31 of the mounting bracket 1 comprising the slots 45 is then inserted on the bolts 17 set in the other post 9 of the set. Such a sliding shown with the arrow "B" in FIG. 3, is allowed by the slots 45 which extend in the bottom wall of the other end portion 31 and thus allow the bolts 17 to pass through and enter the U-shaped end portion 31.

Then, nuts 18 can be screwed onto the bolts 17 projecting in the two end portions 29, 31, thanks to the U-shape of these end portions which give access to the fingers and to a key. In practice, washers 49 can also be inserted in between the mounting bracket 1 and the rear post 9 if the mounting bracket's length does not completely fill the space between the two posts 7, 9.

The desired shelving accessory may finally be fixed to the front surface of the mounting bracket 1 and to the front surface of another identical mounting bracket 1 similarly installed into the other set of front and rear posts, either directly or via its supporting rails or runners 19, 19', in order to complete the installation.

Preferably, the depth of the U-shaped end portions 29, 31 and the position of their holes 43 and slots 45 are selected to cause the front surface 23 of the mounting bracket 1 to extend flush with, or to project out inwards the supporting frame structure, in order not to interfere with the movement of the drawers or other foldable or slidable accessories.

The mounting bracket 1 as disclosed hereinabove can thus be used to install in a retrofit manner in numerous brands of existing shelving units, a shelving accessory selected amongst open and closed file drawers, storage drawers, roll-out frames, flipper doors and suspended, transversal bars. It is very simple structure and installation, and very efficient in use.

We claim:

1. A mounting bracket for use to install in a retrofit manner a shelving accessory into an office shelving of the type comprising at least two sets of front and rear posts forming together a supporting frame structure of rectangular cross-section, the front and rear posts of each set having perforated surfaces facing each other, each perforated surface comprising at least one vertical row of equally spaced apart openings in which supporting bolts can be inserted without having to dismantle the office shelving, wherein said mounting bracket comprises:

(a) an elongated plate having a central portion defining a rectangular front surface with two opposite edges, and two opposite end portions adjacent said opposite edges, and (b) connecting means on said front surface to fix directly or indirectly one side of said shelving accessory;

(c) said plate, including its two opposite end portions, having such a length as to fit snugly between the perforated facing surfaces of the front and rear posts of anyone of said sets;

(d) each of said opposite end portions being U-shaped and including:

an inner lateral wall integrally projecting rearwardly from the corresponding edge of the front surface;

a bottom wall extending parallel to said front surface rearwards the same; and an outer lateral wall projecting forwardly from the bottom wall, said outer lateral wall extending perpendicularly to said bottom wall and said front surface so as to extend flat onto one of said perforated facing surfaces of the front and rear posts of one of said sets when the mounting bracket is installed therebetween;

(e) one of said opposite end portions comprising a set of at least two holes extending through at least its outer lateral wall, said at least two holes being respectively spaced apart so as to match at least two corresponding openings in the perforated surface of the adjacent post when installed, (f) the other one of said opposite end portions comprising a set of at least two elongated slots extending parallel to each in a direction perpendicular or at angle with respect to the adjacent edge of the front surface, each slot extending over part of the outer lateral wall and part of the bottom wall of said other opposite end portion, said at least two slots being respectively spaced apart so as to match at least two corresponding openings in the perforated surface of the adjacent post when installed, whereby, in use, said mounting bracket can be installed between any of said sets by:

(i) first inserting bolts into two pairs of facing openings selected at a required height in the perforated facing surfaces of the front and rear posts of said set, the openings in each post being selected so as to able to match the slots and holes in the end portions of the mounting bracket;

(ii) positioning the mounting bracket so that its front surface faces the other set of front and rear posts and inserting onto the bolts set in place in one of said posts of said set, the one end portion of said mounting bracket comprising the holes, (iii) sliding the other end portion of the mounting bracket comprising the slots on the bolts set in the other one of the posts of said set, said sliding being allowed by the slots which extend in the bottom wall of said other end portion and thus allow the bolts to pass through, and enter said U-shaped other end portion;

(iv) screwing nuts onto the bolts projecting in said two U-shaped end portions; and (v) fixing said shelving accessory to the front surface of said mounting bracket and to the front surface of another identical mounting bracket similarly installed into the other set of front and rear posts, or to the top surfaces or edges of said mounting brackets.

2. The mounting bracket of claim 1, wherein the U-shaped end portions and their holes and slots are sized and positioned to cause the front surface of the mounting bracket to extend flush with or project out inwards said supporting frame structure.

3. The mounting bracket of claim 2, for use to install a shelving accessory supported by a pair of rails or runners, said shelving accessory being selected from the groups consisting of open and closed file drawers, storage drawers, roll-out frames and flipper doors, wherein said connecting means are designed to attach one of said rails or runners.

4. The mounting bracket of claim 3, wherein said connecting means consist of through-holes punched out in said front surface, said through-holes being sized and positioned to receive fixation hooks projecting from one of said rails or runners.

5. The mounting bracket of claim 4, wherein the U-shaped end portions comprise more than two closely spaced apart slots and holes whose spacing is a multiple of the spacing between the openings of the front and rear posts, so as to allow fine adjustment in height of said mounting bracket along said front and rear post.

6. The mounting bracket of claim 5, consisting of a single piece of metal formed and punched into the desired shapes.

7. The mounting bracket of claim 1, wherein the U-shaped end portions comprise a plurality of closely spaced apart slots and holes whose spacing is a multiple of the spacing between the openings of the front and rear posts, so as to allow fine adjustment in height of said , mounting bracket along said front and rear posts.

8. The mounting bracket of claim 7, consisting of a single piece of metal formed and punched into the desired shape.

* * * * *